US005184968A

United States Patent [19]

Michalochick et al.

[11] Patent Number: 5,184,968

[45] Date of Patent: Feb. 9, 1993

[54] FLOATATION SWIMWEAR

[76] Inventors: Marise M. Michalochick, 1100 Las Cruces Dr.; Colleen M. Damweber; Robert G. Michalochick, all of 1100 Las Cruces Dr., Virginia Beach, Va. 23454

[21] Appl. No.: 813,777

[22] Filed: Dec. 27, 1991

[51] Int. Cl.[5] ..... B63C 9/10

[52] U.S. Cl. ..... 441/116; 441/102; 441/106; 441/113; 441/118

[58] Field of Search ..... 441/102, 116, 115, 114, 441/118, 117, 120, 113

[56] References Cited

U.S. PATENT DOCUMENTS

| | | | |
|---|---|---|---|
| 3,050,753 | 8/1962 | Baker | 441/115 |
| 3,094,722 | 6/1963 | Lerner | 441/102 |
| 3,094,724 | 6/1963 | Lerner | 441/118 |
| 3,134,994 | 6/1964 | Christofferson | 441/102 |
| 3,144,668 | 8/1964 | Palesoti | 441/102 |
| 4,263,686 | 4/1981 | Jarvis | 441/116 |

FOREIGN PATENT DOCUMENTS

| | | | |
|---|---|---|---|
| 631920 | 11/1961 | Canada | 441/102 |
| 304135 | 12/1932 | Italy | 441/116 |

*Primary Examiner*—Sherman Basinger
*Assistant Examiner*—Thomas J. Brahan
*Attorney, Agent, or Firm*—Sughrue, Mion, Zinn, Macpeak & Seas

[57] ABSTRACT

A one-piece swimsuit having a lower pants portion and a two-ply upper portion is provided with a one-piece floatation member between the two plies of the upper portion of the floatation member. The floatation member may be of floatation foam rubber and extends over the chest, upper back and shoulders of a wearer. The two-ply fabric may be an open mesh knitted or woven fabric.

6 Claims, 1 Drawing Sheet

FIG. 1
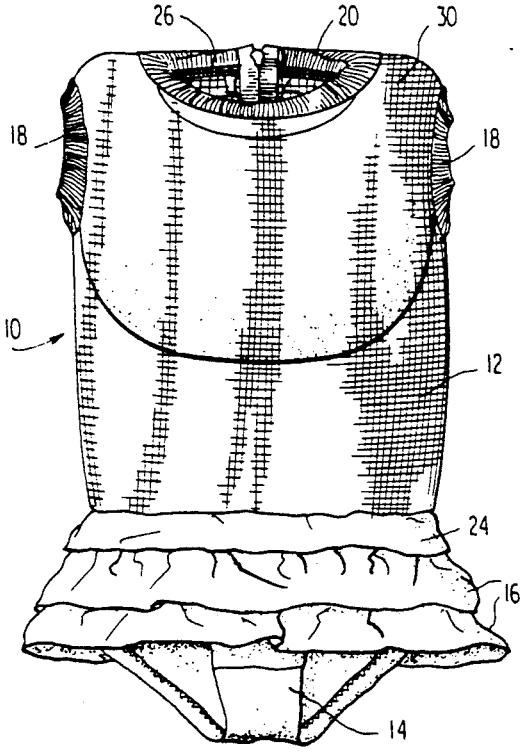
FIG. 2
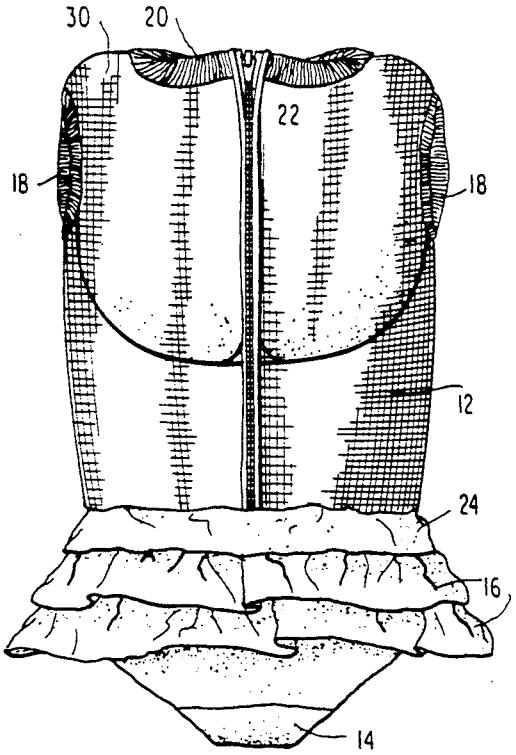
FIG. 3
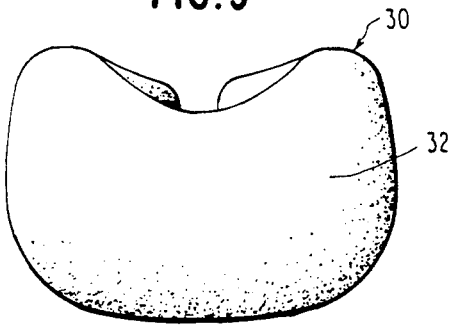
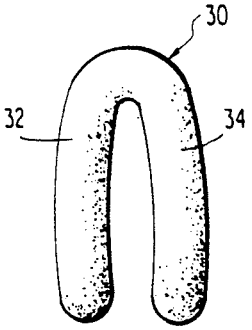
FIG. 5
FIG. 4
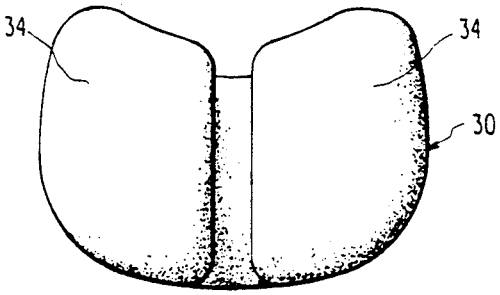

FLOATATION SWIMWEAR

BACKGROUND OF THE INVENTION

The present invention is directed to floatation swimwear and more specifically to a one-piece swimsuit having top and bottom components with a built-in floatation component inside the upper component adjacent to the chest and upper back and extending over the shoulders.

A great number of people die every year from accidental drowning. A large percentage of them are children too young to have learned to swim and to float. Others at unusual risk of drowning are the elderly and the infirm, as well as certain handicapped persons. Thus, it is necessary to provide young children, the elderly, the infirm and the handicapped with a floatation device to protect them from accidental drowning when they to be in or near a body of water. However, the present art of floatation devices has certain drawbacks and limitations. Most of the floatation devices presently provided for children are in the form of inflated toys, rings, rafts or the like. Such independent floatation devices are not readily available when a child accidentally falls into a body of water, and they become useless dead weight when punctured. Even when a child is in a body of water with such floatation devices, it is easy for the devices to become separated from the child, either accidentally or by the child removing it.

Other types of floatation devices presently available are of the life vest type for children and adults, which tend to be very bulky and cumbersome. Since the vests are usually held on by readily detachable fastening means, a child or other wearer may remove the vest at inappropriate times, thereby compromising the level of safety intended to be provided. The cumbersomeness of these vests and the plurality of tie strings, straps and fasteners enhance the risk of unsafe use due to improper fastening or failure to use the fastening means. The bulkiness of such vests inhibits any attempt to learn how to swim, which is the most effective means of enhancing the safety of children in water. The difficulty of putting them on is also a deterrent to their use. Examples of such floatation vests are found in U.S. Pat. Nos. 685,757, 4,263,6864,551,107 and 4,689,030.

It is also known to provide a floatation jacket which covers the entire torso of the wearer. Such a jacket is disclosed in U.S. Pat. No. 4,619,622. Floatation devices may be in the form of a plurality of tubes filled with styrofoam pellets which extend about the torso of the wearer below the arm pits. The floatation devices can also be comprised of inflatable tubes. In one embodiment of that patent, the tubular floatation members are disposed vertically but in no instance is there any provision for extending the floatation members over the shoulders of the wearer, providing means of keeping the wearer's face out of the water, providing for a single piece floatation member, providing for the floatation member to be disposed above the bend of the waist of the wearer, or providing for the removal of the floatation member for re-use in another jacket.

A further disadvantage of the prior art is that the floatation devices are worn in addition to a swimsuit garment, thus necessitating uncomfortable layering of materials about the body of the wearer.

SUMMARY OF THE INVENTION

The present invention is directed to new and improved floatation swimwear having a floatation member incorporated directly into the swimsuit construction and extending from a point above the wearer's waist, over the upper chest, over the shoulders and down the upper back of a wearer to a point on the same or nearly the same horizontal plane as the beginning point, to ensure the disposition of the wearer's head above the water while providing substantial freedom of movement and flexibility while in or out of the water.

The present invention provides a one-piece bathing suit consisting of a lower brief component and a two ply upper component connected to the brief component at the waist and a one-piece floatation member disposed between the two plies of the upper component and extending over the chest, shoulders and upper back portion of a wearer, the two ply fabric being comprised of an open mesh fabric and being divided at the rear portion thereof to provide a rear opening having separable fastening means connected thereto.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a front elevational view of a swimsuit with a floatation device incorporated therein in accordance with the present invention.

FIG. 2 is a rear elevational view thereof.

FIG. 3 is a front elevational view of the floatation device per se.

FIG. 4 is a rear elevational view thereof.

FIG. 5 is a side elevational view thereof.

DETAILED DESCRIPTION OF THE INVENTION

The swimsuit 10 shown in FIGS. 1 and 2 is comprised of an upper sleeveless component 12 of a two-ply knitted or woven open mesh fabric attached to a lower pants component 14 by means of stitching. Ruffles 16 have been attached to the lower pants portion to give the impression of a skirt for a female swimsuit embodiment. The detailed construction of the lower component 14 can vary depending upon whether the swimsuit is for a female or for a male.

The upper component 12 is sleeveless and is provided with knitting binding strips 18 about the armholes and a knitted binding strip 20 surrounding the neck opening. The rear of the upper mesh component is provided with a suitable closure 22 extending from the neck band binding strip 20 to the waist band 24. A slide fastener has been shown in the embodiment of FIGS. 1 and 2 but other types of fasteners such as snaps, buttons, hooks or VELCRO-type fasteners may be used.

The entire upper component 12 is constructed from two plies of mesh fabric which are connected to each other to provide an envelope for receiving the floatation member 30. The floatation member 30 is constructed of floatation foam plastic, foam rubber or any other suitable flexible soft buoyant material and extends over the chest, upper back and shoulders of the wearer. The front portion 32 of the floatation member 30 extends continuously across the chest whereas the rear portion is divided in the middle to accommodate the presence of the slide fastener at the rear of the garment. However, in spite of the division for the slide fastener, the two rear portions 34 extend substantially over the entire upper back portion of the wearer. Thus, the floatation member 30 has a substantially inverted U-shaped configuration as shown in FIG. 5 which extends over the shoulders and across the entire upper portion of the body in the front and rear.

The floatation device may be permanently secured between the two plies of mesh fabric in which case the edges of the mesh fabric are completely sewn to each other. If it is desired to have the floatation member removable, suitable detachable connection means can be provided between selected edges of the two-ply upper mesh fabric or between the mesh fabric and the waist band to facilitate the insertion and removal of the floatation member. By way of example, a slide fastener 26 extends about the inside of the neck opening between the binding strip 20 and the inner ply of mesh fabric.

The floatation component is balanced so that a slightly greater buoyancy is provided in the front which helps keep the wearer's face out of the water. The one-piece swimsuit with the built-in floatation component at the chest, upper back and shoulder portions makes it impossible for a wearer to remain head down, supine or prone in the water without significant deliberate effort.

Since the floatation member is made of a floatation foam material, it will not absorb water, even if punctured or ripped. Removal of the component for washing purposes is not necessary since the foam floatation member is washable and is not harmed by household laundry detergents. The use of the open mesh fabric for the upper portion of the garment also aids in washing the floatation member as well as to permit rapid drying of the fabric and the floatation member so as to prevent the formation of mildew.

Since the floatation member is an integral part of the swimsuit itself, a child or mentally infirm wearer cannot fall out of it or intentionally get out of it without help. For this reason, it is best to put the opening and the detachable connecting means 22 in the rear of the garment. The configuration and disposition of the floatation component allows complete freedom of movement of the wearer at the waist, arms and neck so that it is possible for a wearer to swim freely without being unduly encumbered.

The use of the mesh fabric component for containment of the floatation member also provides protection of the wearer's skin from the chafing effect which might occur if the floatation member was worn directly against the skin. The mesh fabric should be of a fabric material which has stretchable properties. The fabric mesh component thereby has a degree of elasticity which allows greater freedom of movement and also allows the upper portion to stretch or "grow" to some degree with the growth of the wearer and resists tearing. Built into the construction of the single piece swimsuit is such reinforced elastic stitching as is required to provide adequate resistance to separation of the seams under stressful use.

Since the swimsuit with the floatation device incorporated therein appears as a conventional swimsuit, the resistance of a child or other user to wearing protective floatation gear is substantially reduced. The floatation device does not require the use of straps or buckles which are found on conventional floatation devices such as life vests, which have proven to be rather difficult and time consuming to put on, as well as being bulky and uncomfortable while being worn in comparison with the built-in floatation component of the present invention.

While the use of a mesh fabric is preferred, any other fabric having appropriate elastic and breathability properties may be used. Likewise, any suitable fabric having elastic properties ma be used for the lower portion of the garment.

While the invention has been particularly shown and described with reference to preferred embodiments thereof, it will be understood by those in the art that the foregoing and other changes in form and details may be made therein without departing from the spirit and scope of the invention.

What is claimed is:

1. A one-piece swimsuit having a floatation member incorporated therein comprising a lower pants component and a two-ply upper component having neck and arm openings and a rear opening having detachable closure means, said two-ply upper portion having peripheral edges secured to each other and to said lower portion to define a closed compartment between the plies and a one-piece floatation member disposed in said compartment which extends only over the upper chest, shoulders and upper back of a wearer, said one piece floatation member having a U-shaped configuration with front and rear portions extending downwardly to an equal extent from shoulder portions and extending laterally to the same extent and having a uniform thickness, with a division in the middle of the back portion of the floatation member thereby providing greater buoyancy in the front than in the rear such that the wearer cannot remain in a prone or face down position.

2. A one-piece swimsuit as set forth in claim 1, wherein said two-ply upper portion is comprised of two piles of open mesh fabric with elastic properties.

3. A one-piece swimsuit as set forth in claim 2, further comprising detachable connecting means between the two plies of said fabric to provide an opening whereby the floatation member is removable.

4. A one-piece swimsuit as set forth in claim 2, wherein the mesh fabric is soft, non-irritating and the one-piece floatation member is contoured to comfortably fit the curved shape of the upper torso and shoulders.

5. A one-piece swimsuit as set forth in claim 1, wherein said floatation member is comprised of a single piece of floatation foam material.

6. A one-piece swimsuit as set forth in claim 1, wherein the fabric material used in the swimsuit components and the stitching used to secure the fabric components together are of a reinforced type which resists tearing and separation under stressful use, but also provides elasticity properties.

* * * * *